US012440014B2

(12) United States Patent
Mouhamad

(10) Patent No.: US 12,440,014 B2
(45) Date of Patent: Oct. 14, 2025

(54) HAIR COMB AND APPLICATOR DEVICE

(71) Applicant: MYANA NATURALS LIMITED, Wales (GB)

(72) Inventor: Youmna Mouhamad, Wales (GB)

(73) Assignee: MYANA NATURALS LIMITED, Wales (GB)

( * ) Notice: Subject to any disclaimer, the term of this patent is extended or adjusted under 35 U.S.C. 154(b) by 391 days.

(21) Appl. No.: 17/795,565

(22) PCT Filed: Jan. 22, 2021

(86) PCT No.: PCT/EP2021/051537
§ 371 (c)(1),
(2) Date: Jul. 27, 2022

(87) PCT Pub. No.: WO2021/151803
PCT Pub. Date: Aug. 5, 2021

(65) Prior Publication Data

US 2023/0088345 A1 Mar. 23, 2023

(30) Foreign Application Priority Data

Jan. 31, 2020 (GB) ..... 2001335

(51) Int. Cl.
*A45D 24/24* (2006.01)
*A45D 24/10* (2006.01)

(52) U.S. Cl.
CPC ..... *A45D 24/24* (2013.01); *A45D 24/10* (2013.01)

(58) Field of Classification Search
CPC ..... A45D 24/22; A45D 24/24; A45D 24/10
USPC ..... 132/112, 116
See application file for complete search history.

(56) References Cited

U.S. PATENT DOCUMENTS

| | | | | |
|---|---|---|---|---|
| 2,461,789 A * | 2/1949 | Usai | A45D 24/24 132/148 |
| 2,758,606 A | 8/1956 | Usai | |
| 2,865,383 A | 12/1958 | Mcdougall | |
| 4,147,174 A * | 4/1979 | Peilet | A45D 24/42 132/119 |
| 5,086,793 A | 2/1992 | Kingsford | |
| 8,967,156 B1 | 3/2015 | Skidmore | |
| 9,210,982 B2 | 12/2015 | Alsalameh | |
| 2011/0000606 A1 | 1/2011 | Al-Emrani et al. | |

(Continued)

FOREIGN PATENT DOCUMENTS

| | | |
|---|---|---|
| CN | 101772606 A | 7/2010 |
| CN | 102098944 A | 6/2011 |

(Continued)

*Primary Examiner* — Nicholas D Lucchesi
(74) *Attorney, Agent, or Firm* — Smartpat PLC

(57) ABSTRACT

A hair comb and applicator device (1) is disclosed, comprising: a body (10, 20) enclosing a reservoir (5) for containing a hair treatment substance; a plurality of teeth (40) arranged in at least one row; and a roller (30), rotatably mounted within the body, to transfer hair treatment substance from the reservoir to hair during use. The body includes a wall 60 comprising: a concave inner surface (64) providing a seat for the roller and a convex outer surface (61) from which the plurality of teeth (40) extend. A plurality of through slots (62) are provided in the wall (60), the slots (62) being interposed between the plurality of teeth (40) and wherein each slot (62) extends as an arc along the wall.

16 Claims, 5 Drawing Sheets

(56) References Cited

U.S. PATENT DOCUMENTS

| | | | | |
|---|---|---|---|---|
| 2011/0168204 | A1 | 7/2011 | Gueret et al. | |
| 2014/0251363 | A1* | 9/2014 | Wagner | A46B 11/001 132/202 |
| 2015/0101630 | A1 | 4/2015 | Kodama | |
| 2018/0185675 | A1* | 7/2018 | Kern | A61M 35/003 |
| 2018/0213909 | A1 | 8/2018 | Fereyre et al. | |

FOREIGN PATENT DOCUMENTS

| | | | |
|---|---|---|---|
| CN | 106388208 | A | 2/2017 |
| CN | 206576487 | | 10/2017 |
| DE | 19963065 | A1 | 9/2000 |
| EP | 1440629 | A1 | 7/2004 |
| KR | 20110074825 | A | 7/2011 |
| KR | 101227939 | B1 | 1/2013 |
| WO | 2007044538 | A2 | 4/2007 |
| WO | 2014143035 | A1 | 9/2014 |
| WO | 2015037694 | A1 | 3/2015 |

* cited by examiner

HAIR COMB AND APPLICATOR DEVICE

TECHNICAL FIELD

The present invention relates to combined hair comb and applicator device.

BACKGROUND

Hair is typically maintained using either comb or brush type devices. In hair care it is also commonplace to apply therapeutic or cosmetic substances to hair. For example, hair sprays, creams or colouring agents may be applied during or prior to brushing hair with a comb or brush. For convenience, products for application to hair shall be referred to herein as "hair treatment substance" which may include, without limitation, substances for hair cleaning, hair care and therapeutic or cosmetic hair treatment.

Devices have been proposed which combine a comb or brush with an applicator for liquids. For example, U.S. Pat. No. 9,210,982 shows one such example of a liquid-dispensing comb device.

Existing applicator devices may be unsuitable for use with all types of hair treatment products. For example, the spray device of U.S. Pat. No. 9,210,982 may only be suitable for liquid products which are relatively thin (have low viscosity) since thicker substances may tend to clog a spray nozzle. Higher viscosity hair treatment products may, for example include pastes or creams and may for example include products which are intended to be applied to the roots of tightly curled hair (for example Afro type hair).

SUMMARY

There is a desire for an improved device which combines a brush or comb function with that of an applicator and which may, for example, be usable with a wider range of hair treatment substances.

According to a first aspect of the invention, there is provided a hair comb and applicator device, comprising: a body enclosing a reservoir for containing a hair treatment substance; a plurality of teeth arranged in at least one row; and a roller, rotatably mounted within the body, to transfer hair treatment substance from the reservoir to hair during use; wherein the body includes a wall comprising: a concave inner surface providing a seat for the roller; a convex outer surface from which the plurality of teeth extend; and wherein a plurality of through slots are provided in the wall, the slots being interposed between the plurality of teeth and wherein each slot extends as an arc along the wall.

The wall may be contiguous with boundaries of the reservoir. For example, the body of the device may define the reservoir and the wall may be a forward portion of the body. The body may be externally profiled to provide a graspable handle portion and the wall may extend away from the handle portion. The reservoir may be closed by the body with the roller interacting with the slots to enable application of hair treatment substance from the reservoir onto hair. As such, the roller of the device may function as both an applicator and a closing member for the reservoir. Advantageously, when the device is not in use, the roller is typically stationary, and the reservoir may be effectively closed. Since the reservoir may be effectively closed (and for example sealed) when the device is not in use the device may be suitable for use in both wet and dry environments. In wet environments ingress of water into the reservoir may be avoided and in dry environments leakage of the treatment substance from the reservoir may be avoided.

The provision of arc shaped slots along a convex wall has been found to provide an advantageous arrangement in providing a good contact area between the roller and the hair in use. As such, embodiments of the invention have been found to provide effective transfer of hair treatment substance from the reservoir to hair even when using relatively high viscosity substances. It is believed that this is effective in both ensure that frictional engagement between the hair and the roller rotates the roller relative to the body and that a lengthwise area of the hair is able to be brought into contact with the roller.

Due to the convex external profile, the wall extends outwardly from the housing. The wall may conform closely to the profile of the roller to ensure good contact between extending outwardly from the housing. The conformal nature of the wall and the roller may ensure that the slots are extend along the surface of the roller. The wall may for example be formed as a longitudinal cylinder segment. Each slot may extend circumferentially around the cylinder segment.

The longitudinal cylinder segment may have a central angle of greater than 90 degrees, for example the central angle may be obtuse. For example, the cylindrical segment may be at least a quadrant of a cylinder. For example, the wall may define a semi-cylinder profile. A cylindrical segment having a central angle of greater than 90 degrees may ensure that the curvature of the wall is pronounced and that the slots extend around a significant proportion. For example, each slot may extend longitudinally around a circular segment having an arc length with a central angle of greater than 90 degrees.

The teeth may extend radially outward relative to the cylinder. The teeth may be configured as a wide toothed comb, for example such an arrangement is advantageous for afro hair. For example, the spacing between adjacent teeth may be at least 5 mm and may for example be approximately 1 cm.

Each tooth may for example be blade-shaped. It will be appreciated that a blade shaped tooth may have a generally thin and flat cross-sectional profile. For example, each blade may have an elongate cross sectional. The lengthwise direction of the cross section at the root of the blade is generally aligned with, for example parallel to, the longitudinal direction of an adjacent slot. The blade shaped teeth may have a simple shape for example they may have a rectangular cross section. The blade shape may alternatively narrow to an edge. For example, the teeth may have a bevelled, rounded or chamfered edge. In some embodiments the blades may have an elliptical cross-section. Advantageously, the blades may be double edged (and may, for example, have a symmetric cross section) which allows the comb to be passed through the hair in either direction. Likewise, the profile of the wall and/or the slots may be identical on both sides of the teeth. As such, the device may be configured for both left-handed and right-handed use.

Each tooth may extend longitudinal from a root proximal to the body to a tip distal to the body. Each tooth may be tapered towards the tip. The tip may for example be rounded.

The use of blade shaped teeth provides a device which is particularly suitable for use with curly or Afro-Caribbean hair. For clarity and convenience, such hair will be referred to herein as "Afro hair" but it will be appreciated that this is not intended to be narrowly interpreted and may include other curly hair which shares similar characteristics. Afro hair is generally distinct in that it has hair strands which grow in tight curls. As a result, afro-hair may have specific care requirements and specific hair treatment products may be used with afro-hair (for example to separate and/or untangle and/or straighten hair strands).

The roller may have a radius of between approximately 1 and 3 cm. It has been found that a roller of such dimensions provides a good combination of surface to transfer hair treatment substance and to frictionally engage with the hair (to rotate the roller in use). Further the roller size has been found to provide a good inertia to the roller once rotating such that it continues to distribute and transfer product during combing action.

The roller may comprise a cylindrical drum. The cylindrical drum may have a substantially uniform cross sectional diameter. The use of a cylindrical drum has been found to be advantageous in providing an arrangement in which the hair treatment substance self-seals the opening around the slots when the roller is not rotating (for example in contrast to a roller in which significant recesses are provided between the slots).

The roller may comprise a textured surface profile. A textured surface profile has been found to provide a useful advantage in increasing the engagement between the roller an hair during use such that effective rotation of the roller (relative to the device) is provided.

The textured surface profile may be arranged in a plurality of circumferential bands spaced longitudinally along the roller. Each band may be positioned for alignment with a slot (i.e. when the device is assembled). Smooth roller sections may be provided between the circumferential bands and may, for example, provide a sealing surface which is closely aligned with the inner surface of the wall.

The textured surface profile may for example comprise a plurality of radial projections extending from the surface of the roller. Radial projections have been found to be particularly effective in engaging with the hair to cause rotation of the roller but without entangling hair. The radial projections may for example each comprise a partial spheroid extending from the surface of the roller. Each projection may for example extend by around 1 to 3 mm from the surface of the roller. The projections may be arranged as a circumferential array of projections, for example each circumferential bands on the roller may comprise an array of radial projections.

Each end of the roller may comprise an end wall. Each end wall may have a longitudinally projecting pin member extending therefrom to provide an integral spindle. The integral spindle may be used to rotatably mount the roller within the housing, for example being received in a corresponding recess in the interior of the body. For example, the body may comprise a pair of opposing recesses for receiving the pin member at each end of the roller.

The body comprises first and second resiliently engageable housing portions. The housing portions may for example have a snap fit engagement. For example, one housing portion may form a lid arrangement which closes the other housing portion. The housing portions may be configured to be engagable/disengageable by a user to enable the reservoir to be filled with hair treatment substance and/or for cleaning and maintenance of the device.

Engagement of the first and second housing portions retains the roller in position within the housing. For example, the roller may be retained in an open sided recess and the engagement of the housing portions may close the side opening of the recess.

Whilst the invention has been described above, it extends to any inventive combination of the features set out above or in the following description or drawings.

BRIEF DESCRIPTION OF THE DRAWINGS

Embodiments of the invention may be performed in various ways, and embodiments thereof will now be described by way of example only, reference being made to the accompanying drawings, in which.

DETAILED DESCRIPTION

It may be noted that upper and lower are used herein to conveniently refer to the device in its typical in use orientation. Thus, it will be understood that upper may generally mean a surface, component or direction which is proximal to the user's hand during use and lower may be used to generally mean the surface, component or direction distal to the user's hand. However, it will be appreciated that such references are not intended to be limiting and that the device may take any orientation in use. Likewise, any references to circumferential, radial or axial directions may be interpreted broadly as general geometric terms of orientation and, for example, do not exclude that a component may have a non-circular or irregular form.

Figure 1:
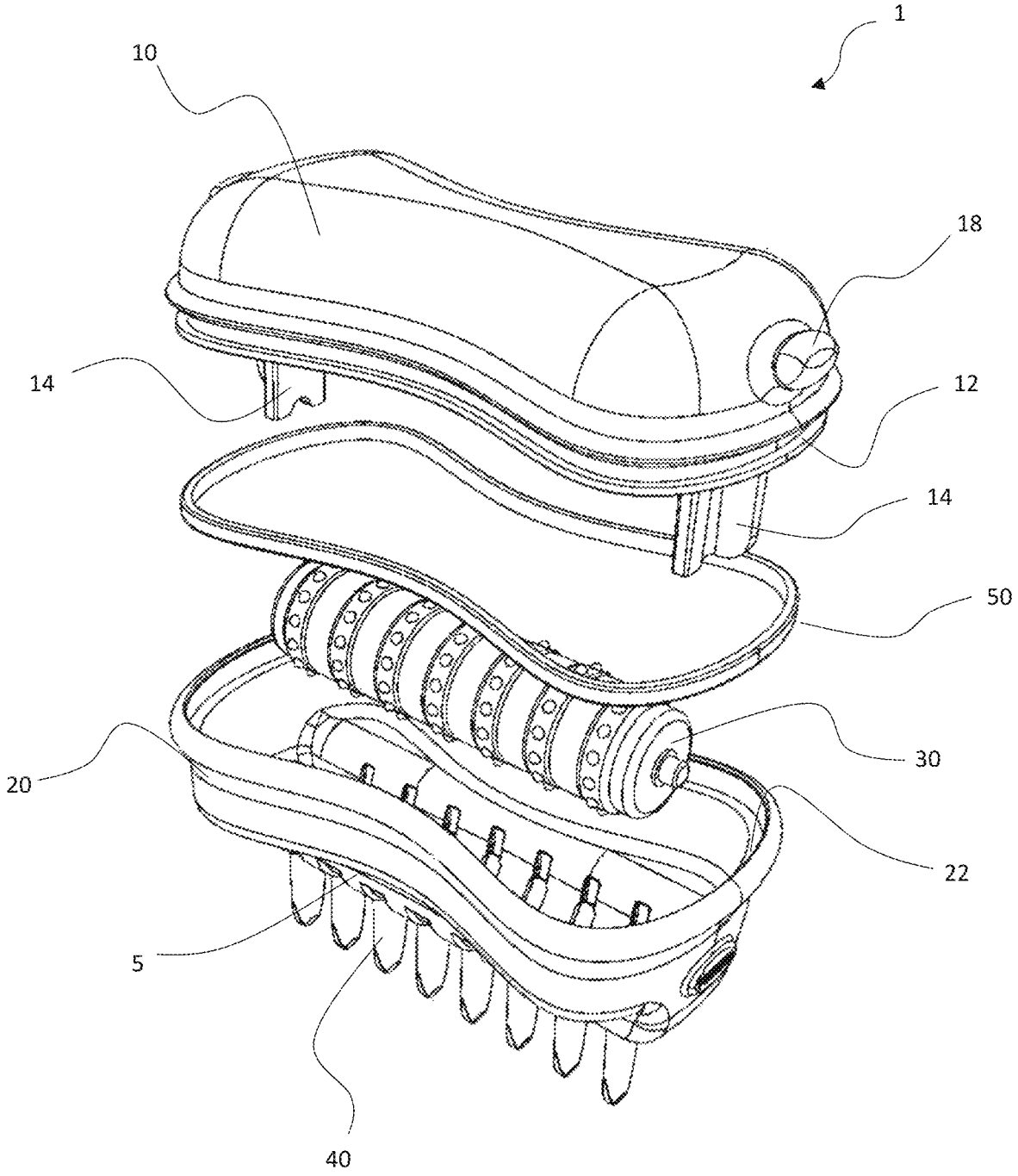
FIG. 1 shows an exploded perspective view of a device in accordance with an embodiment.
Figure 2A:
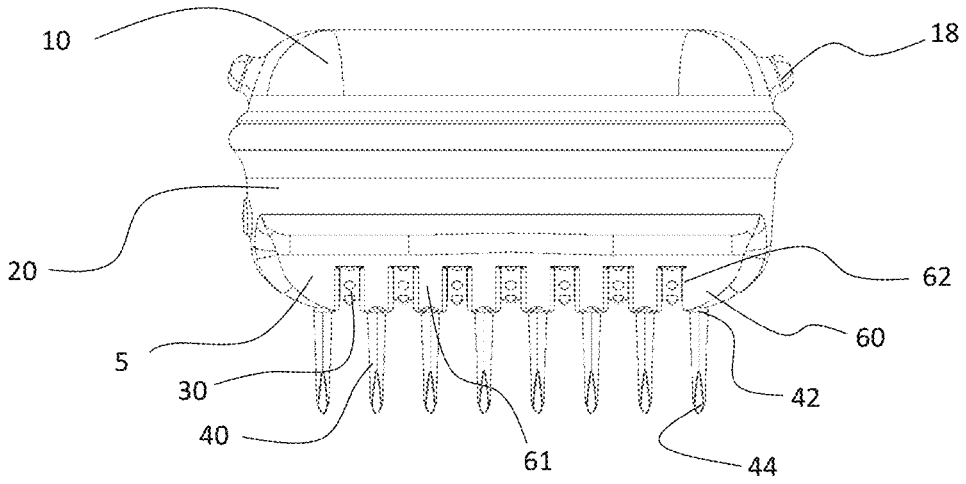
FIGS. 2A, 2B and 2C show side, top and bottom views of the device.
Figure 2B:
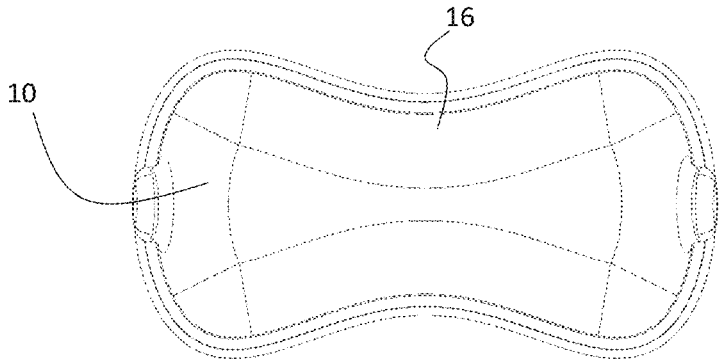
Figure 2C:
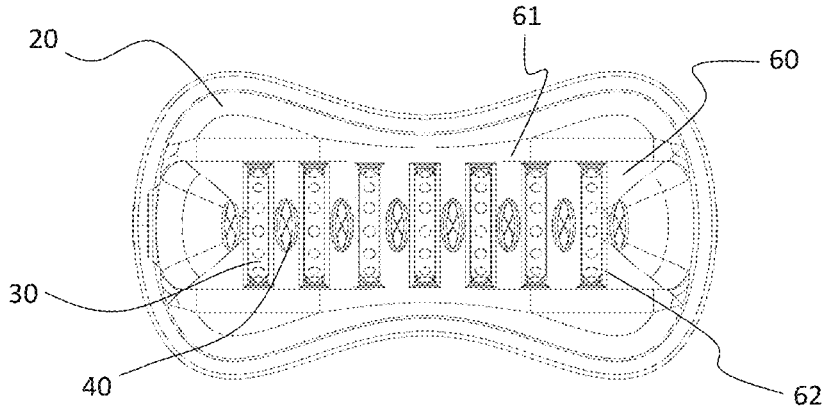

A hair comb-applicator device 1 in accordance with an embodiment is generally shown in FIGS. 1 and 2. The comb-applicator device 1 comprises a body formed of inter-engageable upper 10 and lower 20 housing portions. The body encloses a reservoir void 5 which can be filled in use with a hair treatment substance of the user's choice. A comb or brush arrangement is provided in the form of at least one row of teeth 40 projecting outwardly from the body. A roller 30 is rotatably mounted within the body to transfer hair treatment substance from the reservoir 5 to hair which passes between the teeth 40 of the device 1 during use. As will be explained in further detail below, the body includes a wall 60, formed as part of the lower housing 20, which is specifically shaped and configured to enhance the transfer of hair treatment substance during use. The inner surface 64 of the wall 60 generally conforms to the outer surface profile of the roller 30 and may, therefore, have a concave surface shape. The inner surface 64 may be considered to define a seat for the roller 30. The outer surface 61 of the wall 60 carries the plurality of teeth 40 which project outwardly away from the surface 61. The outer surface 61 has a convex shape and including a number of slots 62 extending through the wall and each interposed between the plurality of teeth 40. It may be noted that the slots 62 extend generally circumferentially relative to the underlying roller 30 and extend as a circular arc around the surface of the wall 60. The convex shape of the outer surface 61 of the wall 60 acts to guide hair both between the teeth 40 and across the sections of the roller 30 which are exposed by the slots 62 (as discussed in further detail below).

Figure 5:
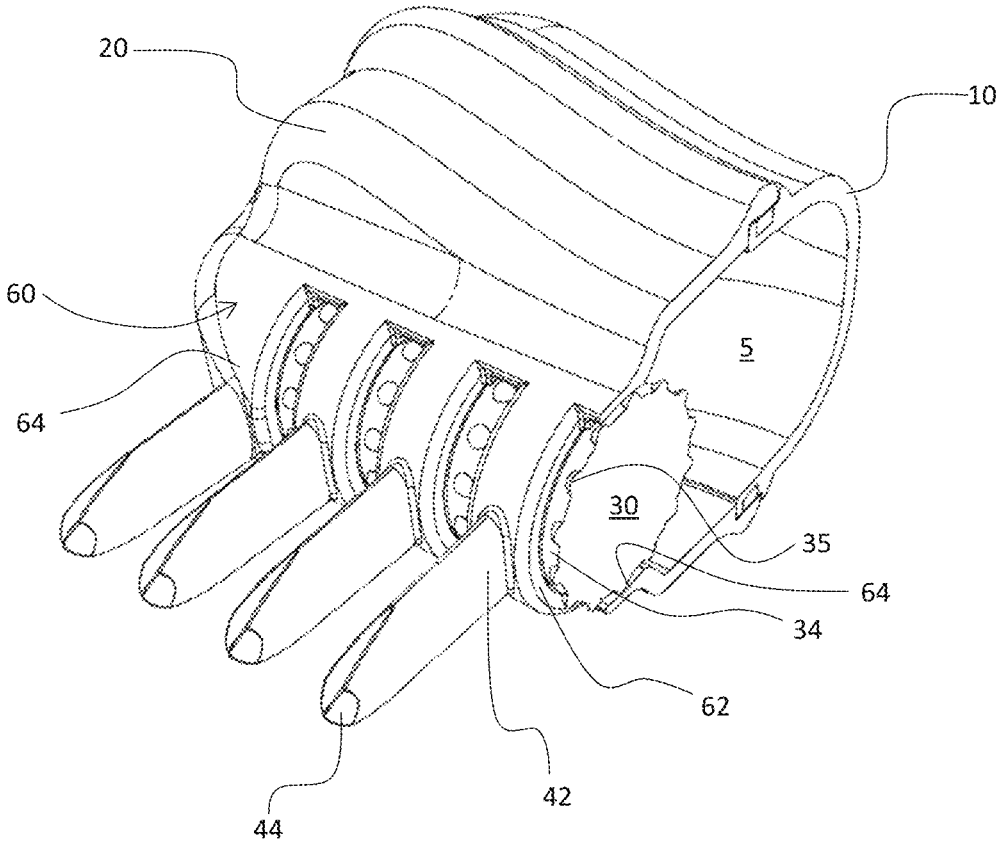
FIG. 5 shows a transverse cross-section through a device according to an embodiment.

As best seen in FIGS. 1 and 5, the housing portions 10, 20, which may for example be injection moulded plastic, form a body which may be considered to have a generally cuboid shape with chamfered or filleted edges. It will be appreciated that the both the overall shape and details of the body may be readily adapted for aesthetic or ergonomic reasons. For example, in the illustrated example the body is formed with a waisted profile 16 to provide a shape which is readily graspable in use with the body of the device seated in the palm of a user's hand and the teeth extending away from the hand.

The two housing portions 10, 20 are configured as opposing clamshell portions such that they meet at an interface extending fully around a periphery of the housing. When connected the housing portions define an internal void 5 which provides a reservoir for receiving hair treatment substance. The interface between the housing portions 10 and 20 may be a resilient "snap-fit" engagement. The housing portions may include complimentary male and female engagement features; for example, one housing portion 10 may include a ridge 12 and the other housing portion 20 may include a corresponding flange 22. A resilient sealing member 50 may be provided between the housing portions 10 and 20, for example having a seat on the flange 22, and may be compressed between the housing portions 10 and 20 to provide a leak free interface. Suitable features such as the horn shaped tabs 18 may be provided on one of each of the housing portions 10, 20 to assist the user in pulling apart the housing portions.

The teeth 40 of the device extend from the wall 60 of the lower housing portion 20. As the illustrated example is specifically adapted for use with afro hair, it may be noted that the teeth 40 are arranged as a single row wide spaced comb. In the illustrated embodiment eight teeth 40 are provided and each have a width of around 0.5 cm and a spacing between adjacent teeth of approximately 1 cm. The teeth 40 are blade shaped having a longitudinal length of approximately twice their width and having a generally elliptical cross sectional profile (see for example the view of FIG. 2C) to provide a smooth combing surface in either direction. The teeth 40 each extend from a root 42 at the housing wall 60 to a tip 44 distal from the housing. It may be noted that the teeth are each tapered towards the tip 44.

It will be noted that, in the example the teeth 40 are provided in a single generally central row that extend directly away from one side of the device. This enables the device to be arranged in a handle-less configuration with the body shaped to be graspable within the palm of a user. Such an arrangement is particularly useful for combing hair which is more difficult to manage, for example afro or curly hair. The body also has a symmetrical profile such that it may be readily used in either a left or right-handed manner.

Figure 3:
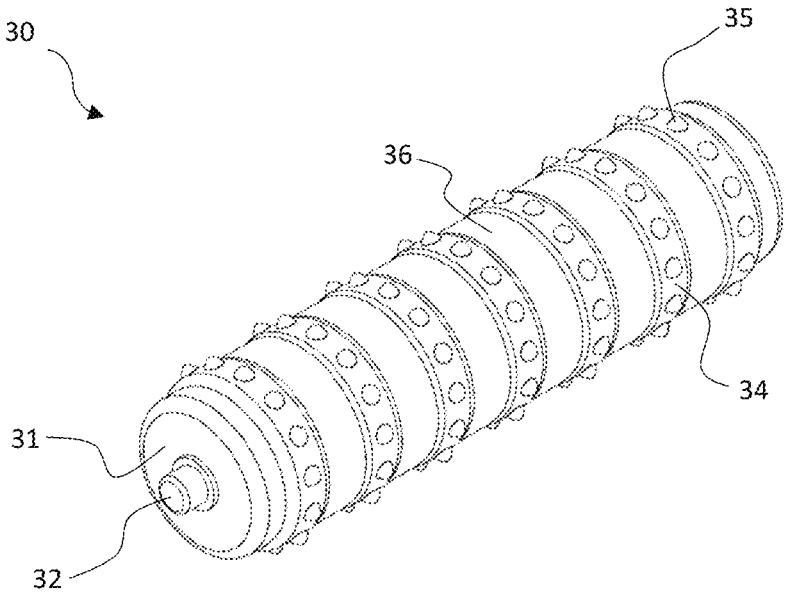
FIG. 3 shows a perspective view of a roller for use in a device according to an embodiment.
Figure 4:
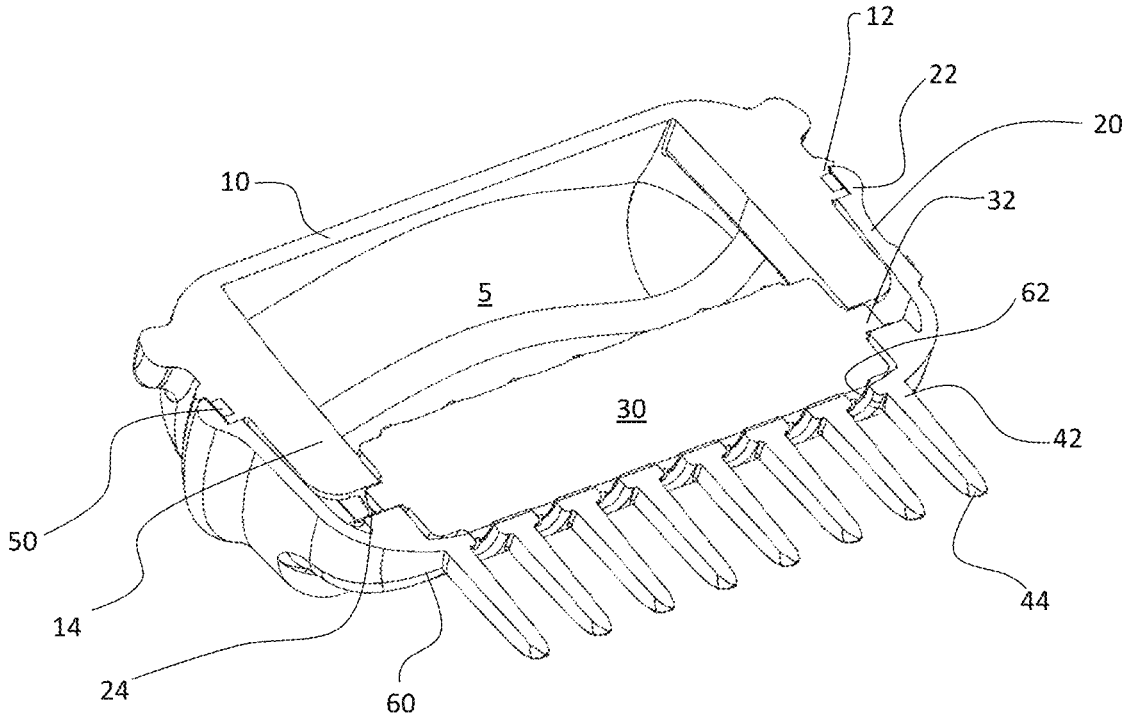
FIG. 4 shows a longitudinal cross-section through a device according to an embodiment.

The roller 30 is shown in isolation in FIG. 3. The roller comprises a central drum 33 having a generally uniform cross-sectional profile and ending at end walls 31. Integral pins 32 extend axially outwardly from each end wall 31 to provide a spindle for rotation of the roller relative to the housing 10, 20. As best seen in the longitudinal cross-section of FIG. 4, the spindle pins 32 are received in an opposed pair of recesses 24 formed in the lower housing 20 which seats the roller close to the inner surface 64 of the wall 60 whilst being free to rotate relative to the wall. Retaining arms 14 extend downwardly from the upper housing 10 and retain the spindle pins 32 in the recesses 24 when the device 1 is in the assembled configuration. It may be noted that the arms 14 may include a cut out 15 to match the profile of the spindle pin 32.

Conveniently, as the roller 30 seats simply in the housing and is captive between the housing portions 10, 20 when the device is assembled. It may, therefore, be appreciated that when the housing portions 10, 20 are separated and the reservoir opened the roller 30 is readily removable from the device. This arrangement may provide a device which can be easily cleaned by the user.

The drum 33 of the roller 30 has an outer surface including textured portions. The textured portions are arranged in a series of bands 34 each aligned with a slot 62 in the wall 60 when the device 1 is assembled. A non-textured or smooth sealing surface 36 is provided in the intervening space between adjacent bands 34. The sealing surface 36 is, in the assembled configuration, closely positioned next to the inner surface 62 of the wall 60 such that a self-sealing effect may be formed with the hair treatment substance when the roller 30 is stationary. It may be noted that the textured bands 34 may be formed as a circumferentially extending rib which is slightly proud of the surface of the drum 33 and may assist in both aligning the textured bands 34 with the slots 62 and with sealing the slot in use. Each textured band 34 may be formed of a circumferentially arranged array of projections 35. Each projection 35 may for example be generally spheroidal projection extending radially outwardly from the surface of the drum 33, for example the projections may be semi-spheroids. The projections may extend from the surface by approximately 2 mm and may have a diameter of similar proportions. In the illustrated example, the projections are spaced apart around the circumference of the drum such that a circumferential spacing is provided between adjacent projections 35 which is of similar dimensions to the projections themselves.

Figure 6A:
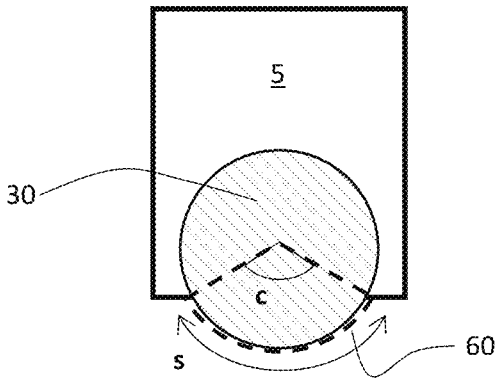
FIGS. 6A and 6B schematically represent the wall profile of devices in accordance with embodiments.
Figure 6B:
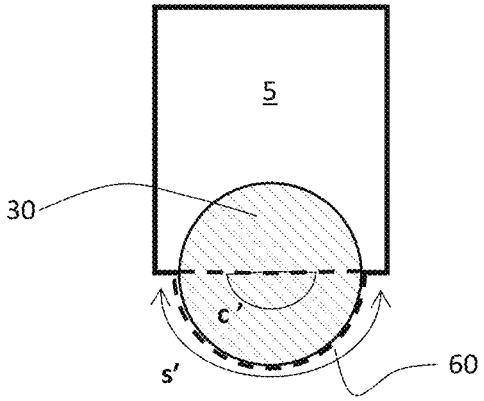

With reference to FIGS. 5 and 6, the shaping of the wall 60 may be more clearly understood. The wall 60 can be considered to have the shape of a longitudinal partial section of a cylinder. The cylindrical section is open into the reservoir 5 defined by the housing and the wall 60 is blended into and generally contiguous with the housing portion 20. The cylindrical section shape of the wall 60 enables the wall to conform closely to the cylindrical roller 30. Such an arrangement both provides a seat for the roller 30 on the inner surface of the wall 64 and ensures that there is a significantly convex curved area of the exterior wall 61 over which hair can be transferred during use of the device. The curved extent of the exterior wall 61 enables the slots 62 to extend longitudinally around a circular arc along a portion of the circumferential surface of the roller 30 (and expose a portion of the textured band 34). As shown schematically in FIG. 6*a* the extend to the cylindrical section formed by the wall (and therefore the curvature of the wall surface) may be defined by the central angle of the cylindrical section. For example, FIG. 6A shows a wall 60 shaped such that the central angle c is an obtuse angle and 6B shows a wall 60' with a central angle of approximately 180 degrees. It may be appreciated that central angles of greater than 180 degrees may mean that the wall 60 overhangs the roller which may provide the disadvantage that the roller cannot be easily removed from the seat (without for example resiliently deforming the housing). Thus, it may be appreciated that the central angle of the cylindrical section may defines the curvature and extent to which the wall extends outwards from the body of the device. As noted by the lines s and s' in FIGS. 6A and 6B it can also be noted that the length of the slot 62 may be extended by using a wall section 60 defined by a cylindrical section with a greater central angle.

In use, the user separates the two housing portions 10 and 20, using the tab 18 to assist in gripping the upper housing 10. The user ensures the roller 30 is positioned in its seat in the lower housing and fills the reservoir 5 with the desired hair treatment substance. The housing portions 10, 20 are then snapped together and sealingly engage. Grasping the device 1 by the handle portion defined by the housing the row of comb teeth 40 is passed through the hair. As hair passes between the comb teeth 40 it passes over and is guided by the surface of the wall 60. This results in hair frictionally engaging the textured bands 34 of the roller 30 which are aligned with the slots 62. Due to the angle and length of contact between the textured bands 34 and hair (which is a result of the shaping of the wall 60 and its slots 62) the relative movement of the hair and device 1 acts to cause the hair to "drag" circumferentially across the roller 30 and cause rotation of the roller relative to the device 1. Due to the symmetric profile of the teeth 40, roller 30, wall 60 and slots 62, it does not matter which direction the user choses to pass hair through the teeth (i.e. the device may be used in a left-handed or right-handed manner). Rotation of the roller enables the portions of the roller facing the reservoir to rotate around into the slots 62 carrying with them hair treatment substance which is then transferred to the hair as the combing action continues. When the users ceases to use the device the roller 30 is no longer rotating relative to the housing and the tight spacing between the inner surface of the wall 64 and the non-textured surface portions 36 of the drum 33 provides a sealing effect against significant leakage of hair treatment substance from the reservoir 5.

Although the invention has been described above with reference to preferred embodiments, it will be appreciated that various changes or modification may be made without departing from the scope of the invention as defined in the appended claims.

For example, whist it has been found that a roller comprising a generally uniform diameter drum is particularly effective in both providing a good sealing interface and avoiding entanglement of hair in use it may be appreciated that a series of discrete disc elements aligned with each slot could be provided as an alternative. Discrete discs could for example be provided with an entirely textured surface profile. The disc members of a roller could be rotatably mounted on a common spindle or could be individually rotatably mounted within the housing. When using such an arrangement the slots may be bounded by a sealing wall extending generally radially into the housing with respect to the roller to provide additional sealing of the reservoir.

It may be appreciated that the example described above is specifically adapted and optimised for use with Afro hair and associated hair treatment products. The skilled person may, therefore, appreciate that the hair comb and applicator device could be adapted for different products and/or hair types in various ways without departing from the present invention. For example, the comb arrangement could be changed to use more smaller and more tightly spaced teeth or could be provided with multiple rows of teeth (for example more of a "brush" type arrangement rather than a wide toothed comb). Further, the number and dimensions of the slots could be adjusted to help control the application of the substance (for example the rate of application) and to adjust the surface area in contact with the hair.

Further, the roller could be adjusted with its physical properties having a direct result upon the dynamics of the device in use. For example, the roller size may be adjusted and/or the shape and nature of the textured surface may be adapted. For example, where the textured surface is a series of radial projections the dimensions and number of projections may be adjusted to provide the desired rotational effect. For example, the periodicity of the projections around the circumference of the roller may be used to control the rate of rotation of the roller that is resultant from the combing action passing hair across the surface.

Whilst the embodiment described above includes a single roller it will be appreciated that the invention is not limited to such an arrangement. For example, some embodiments may utilise two or more discrete rollers to form the applicator arrangement. For example, separate rollers could be arranged in parallel or coaxially.

It may also be appreciated that the whilst the example uses a handle-less configuration having a body shaped to be grasped in the users palm other embodiments may use a configuration in which a distinct handle (extending from or attached to the body).

The invention claimed is:

1. A hair comb and applicator device, comprising:
- a body enclosing a reservoir for containing a hair treatment substance;
- a plurality of teeth arranged in at least one row; and
- a roller, rotatably mounted within the body, to transfer hair treatment substance from the reservoir to hair during use,
  - wherein the body includes a wall comprising:
    - a concave inner surface providing a seat for the roller; and
    - a convex outer surface from which the plurality of teeth extend,
    - wherein a plurality of through slots are provided in the wall, the slots being interposed between the plurality of teeth and wherein each slot extends as an arc along the wall,
    - wherein the wall is formed as a longitudinal cylinder segment and each slot extends circumferentially around the longitudinal cylinder segment, and
    - wherein the teeth extend radially outward relative to the longitudinal cylinder segment.

2. The hair comb and applicator device as claimed in claim 1, wherein the wall defines the longitudinal cylinder segment having a central angle of greater than 90 degrees.

3. The hair comb and applicator device as claimed in claim 2, wherein each slot is a circular segment having an arc length with a central angle of greater than 90 degrees.

4. The hair comb and applicator device as claimed in claim 1, wherein each tooth is blade-shaped.

5. The hair comb and applicator device as claimed in claim 4, wherein each blade-shaped tooth extends longitudinal from a root proximal to the body to a tip distal to the body, and
- wherein each blade-shaped tooth is tapered towards the tip.

6. The hair comb and applicator device as claimed in claim 5, wherein each blade-shaped tooth has an elongate cross sectional and a lengthwise direction of the cross section at the root of the blade-shaped tooth is generally aligned with a longitudinal direction of an adjacent slot.

7. The hair comb and applicator device as claimed in claim 4, wherein each blade-shaped tooth has an elliptical cross-sectional profile.

8. The hair comb and applicator device as claimed in claim 1, wherein the roller has a radius of between 1 and 3 cm.

9. The hair comb and applicator device as claimed in claim 1, wherein the roller comprises a cylindrical drum.

10. The hair comb and applicator device as claimed in claim 1, wherein the roller comprises a textured surface profile.

11. The hair comb and applicator device as claimed in claim 1, wherein each end of the roller comprises an end wall having a longitudinally projecting pin member extending therefrom to provide an integral spindle.

12. The hair comb and applicator device as claimed in claim 11, wherein the body comprises a pair of opposing recesses for receiving the longitudinally projecting pin member at each end of the roller.

13. A hair comb and applicator device, comprising:

a body enclosing a reservoir for containing a hair treatment substance;

a plurality of teeth arranged in at least one row; and a roller, rotatably mounted within the body, to transfer hair treatment substance from the reservoir to hair during use, wherein the body includes a wall comprising:

a concave inner surface providing a seat for the roller; and a convex outer surface from which the plurality of teeth extend, wherein a plurality of through slots are provided in the wall, the slots being interposed between the plurality of teeth and wherein each slot extends as an arc along the wall, wherein the roller comprises a textured surface profile, and wherein the textured surface profile is arranged in a plurality of circumferential bands spaced longitudinally along the roller, each band being positioned for alignment with a slot.

14. The hair comb and applicator device as claimed in claim 13, wherein the textured surface profile comprises a plurality of radial projections extending from the surface of the roller and wherein each band comprises a circumferential array of projections.

15. A hair comb and applicator device, comprising:

a body enclosing a reservoir for containing a hair treatment substance;

a plurality of teeth arranged in at least one row; and a roller, rotatably mounted within the body, to transfer hair treatment substance from the reservoir to hair during use, wherein the body includes a wall comprising:

a concave inner surface providing a seat for the roller; and a convex outer surface from which the plurality of teeth extend, wherein a plurality of through slots are provided in the wall, the slots being interposed between the plurality of teeth, wherein each slot extends as an arc along the wall, and wherein the body comprises first and second resiliently engageable housing portions.

16. The hair comb and applicator device as claimed in claim 15, wherein engagement of the first and second resiliently engageable housing portions retains the roller in position within the body.

* * * * *